US005151058A

United States Patent [19]

Tahara et al.

[11] Patent Number: 5,151,058

[45] Date of Patent: Sep. 29, 1992

[54] SUPPORTING DEVICE FOR OUTBOARD MOTOR

[75] Inventors: Hideo Tahara; Nobuo Makihara, both of Kanagawa, Japan

[73] Assignee: Nissan Motor Co., Ltd., Yokohama, Japan

[21] Appl. No.: 686,449

[22] Filed: Apr. 17, 1991

[30] Foreign Application Priority Data

Apr. 20, 1990 [JP] Japan ..... 2-104750

[51] Int. Cl.[5] ..... B63H 21/26

[52] U.S. Cl. ..... 440/61; 248/642

[58] Field of Search ..... 440/53, 61, 62, 63; 248/640, 641, 642, 643

[56] References Cited

U.S. PATENT DOCUMENTS 3,486,724 12/1969 Adamski ..... 440/61
4,482,330 11/1984 Cook ..... 440/61
4,504,237 3/1985 Blanchard ..... 440/61
4,573,931 3/1986 Andersson et al. ..... 440/61
4,889,507 12/1989 Tahara et al. ..... 440/61

FOREIGN PATENT DOCUMENTS 52-128291 3/1976 Japan .
60-33195 2/1985 Japan .
62-139792 6/1987 Japan .
1-101295 4/1989 Japan .

*Primary Examiner*—Jesus D. Sotelo
*Assistant Examiner*—Stephen P. Avila
*Attorney, Agent, or Firm*—Pennie & Edmonds

[57] ABSTRACT

A supporting device for an outboard motor comprises a stern bracket, and an outboard motor bracket. A guide is arranged to the stern bracket, and thrust and reverse rails are mounted thereto. The outboard motor bracket has one end supporting the outboard motor, and the other end including upper and lower arm portions. The upper arm portion is engaged with the guide, and the lower arm portion includes a thrust roller which is slidably engaged with the thrust and reverse rails.

6 Claims, 6 Drawing Sheets

SUPPORTING DEVICE FOR OUTBOARD MOTOR

BACKGROUND OF THE INVENTION

The present invention relates to a supporting device for an outboard motor.

There is known a supporting device for an outboard motor in which an outboard motor bracket for mounting an outboard motor is movably and rotatably supported to a stern bracket which is fixedly mounted to a transom of a hull on the rear face thereof, thus tilting an outboard motor up (see JP-A 62-139792 and JP-A 1-101295, for example).

The outboard motor should fill various requirements in addition to possibility of its tilt-up during anchorage: Possibility of kick-up operation upon collision with an obstacle such as a driftwood during navigation, possibility of improvement in velocity performance by adjusting a trim angle of a propeller axis with respect to a keel of the hull in accordance with a navigation form, and possibility of reverse lock to prevent a backward rotation of the outboard motor due to backward thrust upon sternway.

The known supporting device for an outboard motor cannot cope with all the requirements, however. Particularly, with regard to the trim angle, a trim cylinder for special use should be arranged to adjust a value of trim angle, or a movable locus of the outboard motor should be altered to obtain a predetermined value of trim angle. Additionally, with regard to the reverse lock, a reverse lock mechanism including a reverse hook and a lock pin as disclosed, for example, in JP 52-128291 and JP-A 60-33195 is difficult to use without constituting an obstacle to lift operation of the outboard motor.

SUMMARY OF THE INVENTION

It is, therefore, an object of the present invention to provide a supporting device for an outboard motor which allows adjustage of a trim angle of an outboard motor in accordance with lift adjustment thereof without a trim cylinder for special use.

It is another aspect of the present invention to provide a supporting device for an outboard motor which ensures a smoothly developed kick-up operation of the outboard motor.

It is still another aspect of the present invention to provide a supporting device for an outboard motor which ensures a reverse lock of the outboard motor without any inconvenience to lift operation of the outboard motor.

There is provided, according to the present invention, a supporting device for an outboard motor, the outboard motor being mounted to a transom of a hull, comprising:

a first bracket mounted to the transom;

a thrust rail mounted to said first bracket;

a reverse rail mounted to said first bracket, said reverse rail being arranged to be opposite to said thrust rail;

a second bracket having one end supporting the outboard motor, and the other end including one portion;

a thrust roller rotatably mounted to said one portion of said second bracket, said thrust roller being engaged with said thrust rail and said reverse rail;

means for allowing to slidably and rotatably move said second bracket relative to said first bracket; and means for driving said second bracket, said driving means having one end connected to the hull and the other end connected to said second bracket.

DETAILED DESCRIPTION OF THE INVENTION

Figure 2:
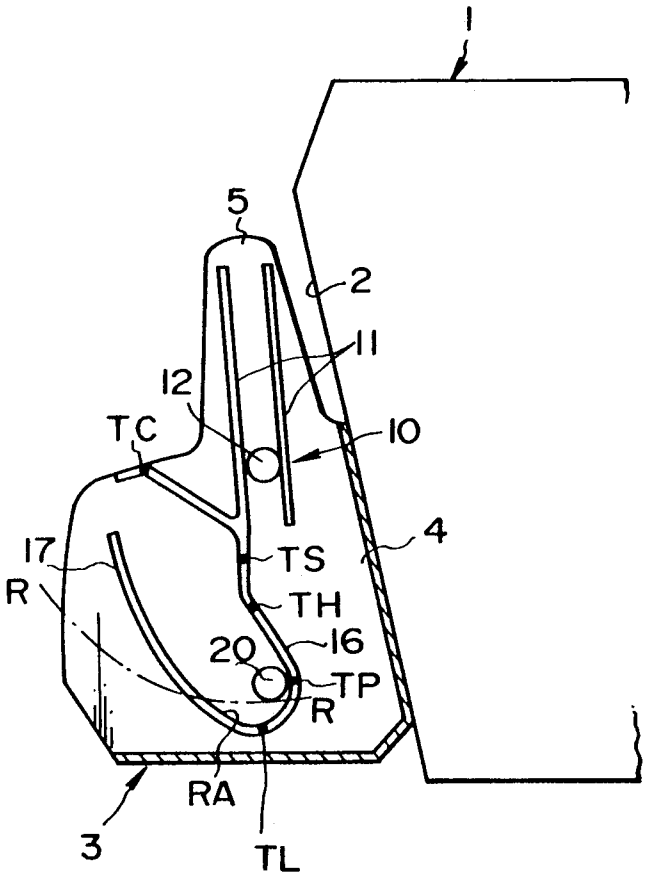
FIG. 2 is a lateral view illustrating a stern bracket with part of the hull.
Figure 3:
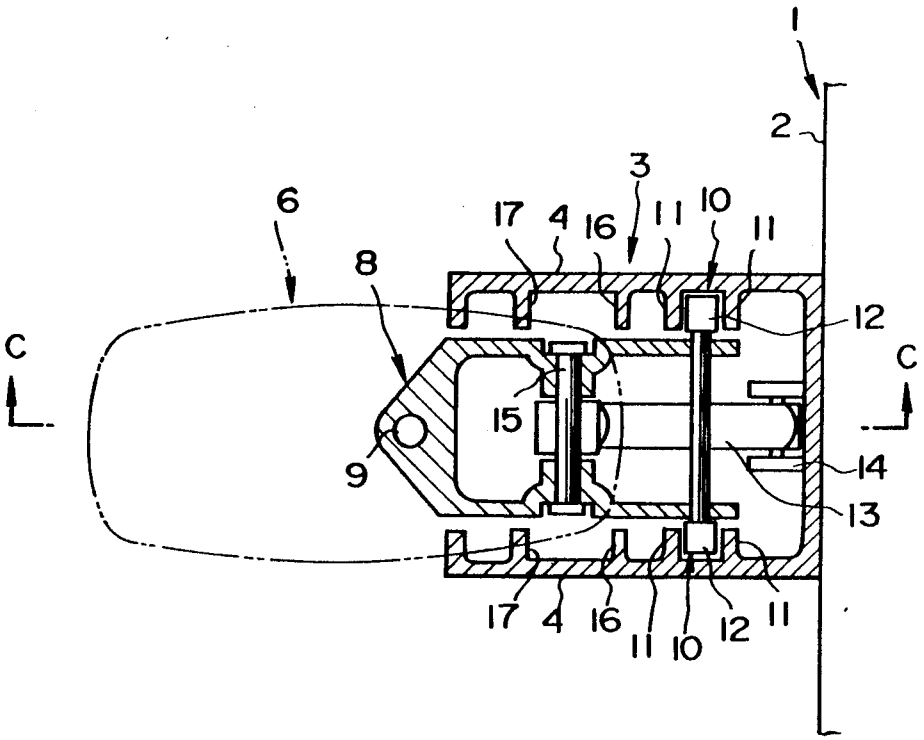
FIG. 3 is a cross section taken along the line A—A of FIG. 1.

Referring to the drawings, particularly to FIGS. 1 to 4, a hull is designated generally by a reference numeral 1, and has a transom 2 at the rear end thereof. Fixedly mounted to the transom 2 on the rear face thereof is a stern bracket (first bracket) 3 which has an U-shaped form in plan view as best seen in FIG. 3, and includes arm portions 5 extending from both side walls 4 thereof.

An outboard motor 6 including a propeller 7 at the lower end thereof is mounted to an outboard motor bracket (second bracket) 8 at the rear end thereof through a rudder shaft 9.

The outboard motor bracket 8 is vertically movably and rotatably mounted to the stern bracket 3 by a guide 10, and a lift cylinder 13 as drive means.

Figure 1:
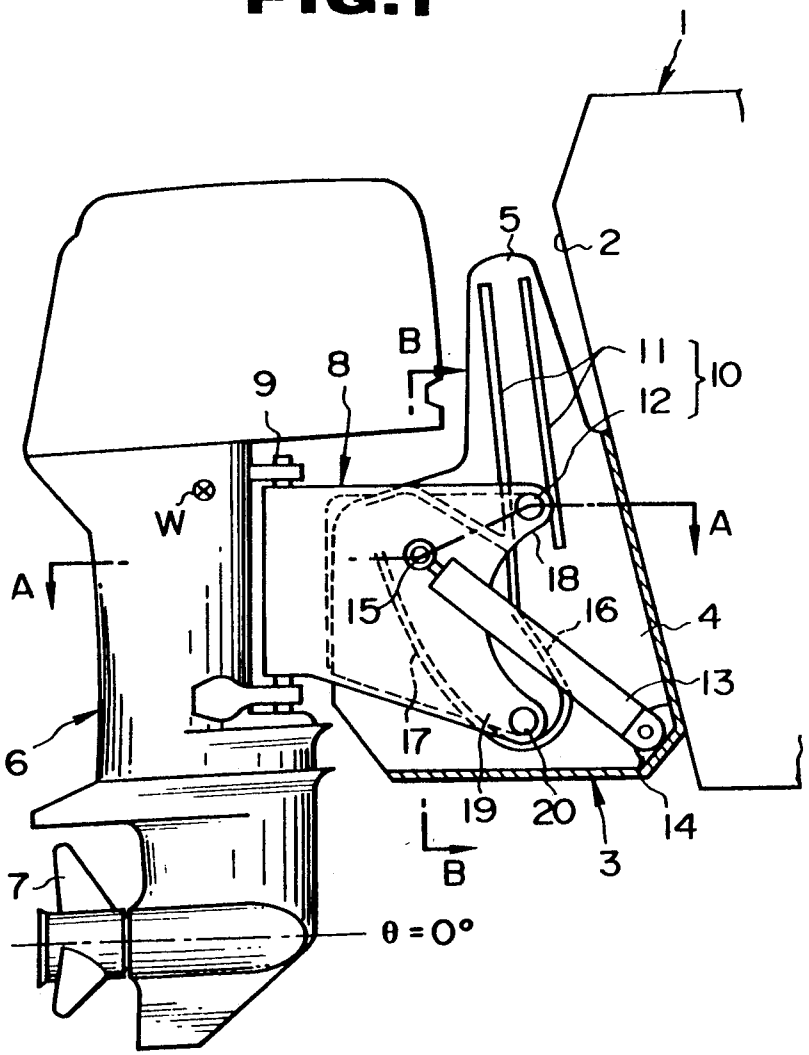
FIG. 1 is a longitudinal section, taken along the line C—C of FIG. 3, illustrating a first preferred embodiment of a supporting device for an outboard motor according to the present invention, with an outboard motor and part of a hull.

As best seen in FIGS. 1 and 2, the guide 10 is arranged on the stern bracket 3, and includes two pairs of guide rails 11, and a pair of guide rollers 12. Each pair of guide rails 11 extend straightly upwardly from an upper end of the reverse of the arm portion 5 to an upper portion of the reverse of the side wall 4. Each guide roller 12 is pivotally supported to an upper arm portion 18 on the outer side thereof which is formed at a front end of a side wall of the outboard motor bracket 8, and it is engaged between the pair of guide rails 11. A lift cylinder 13 has a lower end pivotally supported to a bracket 14 which is arranged at a corner defined by front and bottom walls of the stern bracket 3, and a rod end connected to a support shaft 15 which is supported by both side walls of the outboard motor bracket 8. The lift cylinder 13 is arranged obliquely between the stern bracket 3 and the outboard motor bracket 8.

Figure 4:
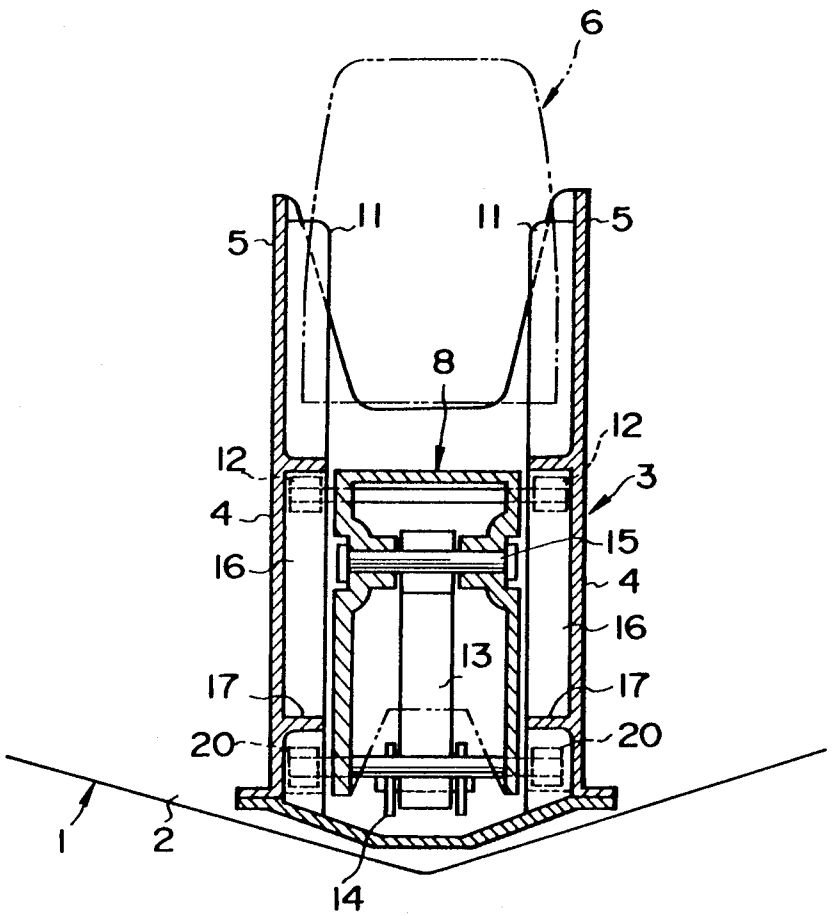
FIG. 4 is a view similar to FIG. 1, taken along the line B—B of FIG. 1.

As best seen in FIGS. 1 and 4, arranged to both side walls 4 of the stern bracket 3 on the reverse thereof are a pair of thrust rails 16, and a pair of reverse rails 17 which are disposed at predetermined intervals in a fore-and-aft direction, respectively.

On the other hand, supported pivotally to lower arm portions 19 on the outer side thereof which are formed at the front ends of both side walls of the outboard motor bracket 8 are a pair of thrust rollers 20 which is urged to move along the thrust rails 16 in accordance with up-and-down motion of the outboard motor bracket 8, and cooperates with the guide 10 to change the trim angle $\theta$ (theta) of the outboard motor 6. Each thrust roller 20 is slidably engaged with the reverse rail 17 upon sternway and kick-up of the outboard motor 6.

In the first preferred embodiment, each thrust rail 16 is connected to the rear one of the guide rails 11 in a continuous manner, and it is also connected to the reverse rail 17 in a continuous manner.

Referring to FIG. 2, the thrust rail 16 has, as an anchorage set position TL of the outboard motor 6, a connecting point with the reverse rail 17 established substantially in the lower center of the side wall 4. In an anchorage state of the outboard motor 6 where the thrust roller 20 is in engagement at the anchorage set position TL, the trim angle $\theta$ (theta) of the outboard motor 6 is equal to 0°. The thrust rail 16 is formed in a curve from the anchorage set position TL to a shallow-sea navigation position TS via a hump position TP, and a high set position TH so as to obtain a predetermined value of trim angle of the outboard motor 6 in each position.

Figure 7:
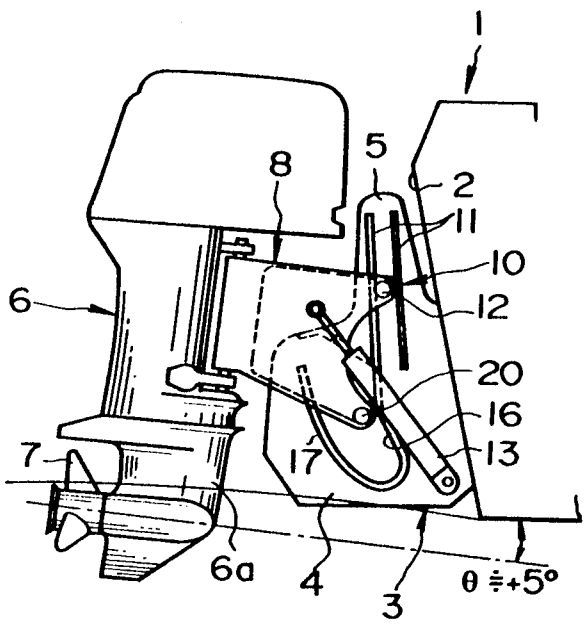
FIG. 7 is a view similar to FIG. 6, illustrating the outboard motor in a high-speed forward navigation.
Figure 6:
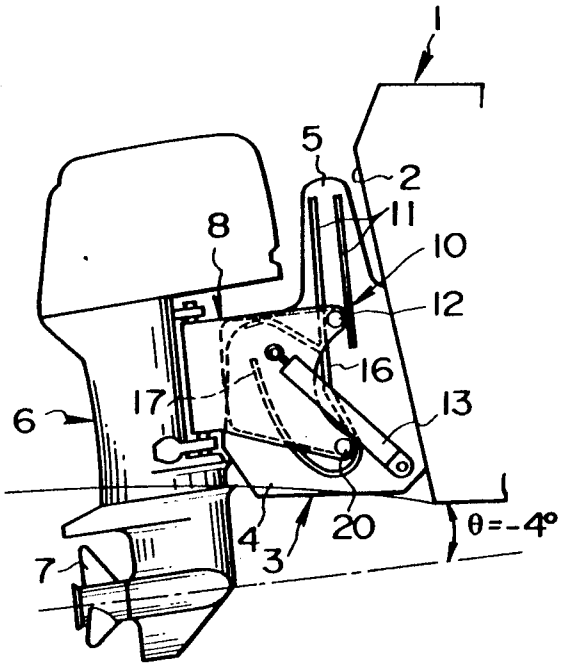
FIG. 6 is a view similar to FIG. 5, illustrating the outboard motor in a hump state.
Figure 8:
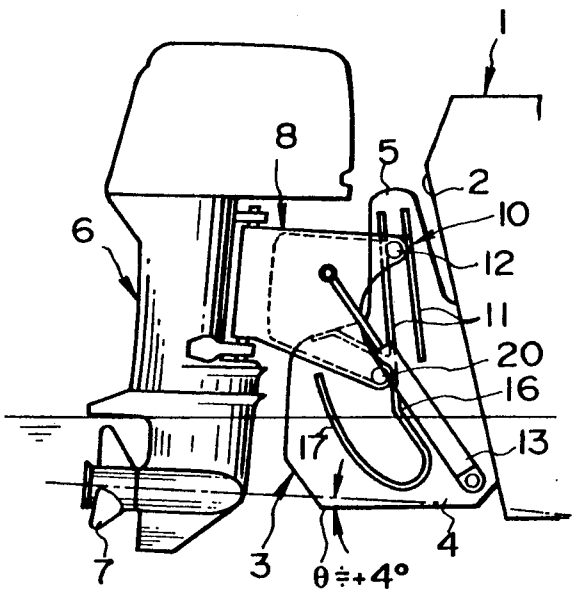
FIG. 8 is a view similar to FIG. 7, illustrating the outboard motor in a state of shallow-sea navigation.

Specifically, referring to FIG. 6, the thrust rail 16 has a first portion formed in an arc extending from the anchorage set position TL to the hump position TP, and the trim angle $\theta$ (theta) is equal to $-4°$ at the hump position TP. Referring to FIG. 7, the thrust rail 16 has a second portion formed substantially in a straight line inclined backward extending from the hump position TP to the high set position TH, and the trim angle $\theta$ (theta) is equal to about $+5°$ at the high set position TH. Referring to FIG. 8, the thrust rail 16 has a third portion formed in a dogleg line extending from the high set position TH to the shallow-sea navigation position TS, and the trim angle $\theta$ (theta) is equal to about $+4°$ at the shallow-sea navigation position TS.

Figure 9:
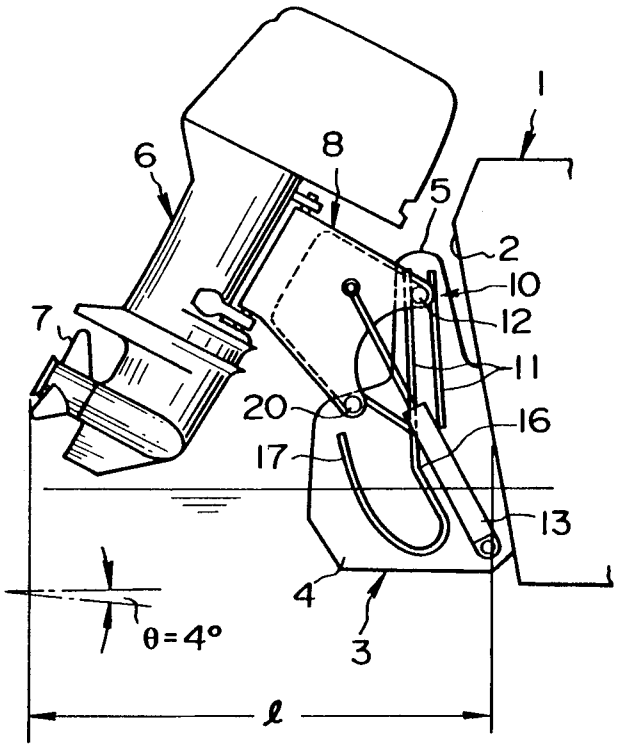
FIG. 9 is a view similar to FIG. 8, illustrating the outboard motor in a tilt state.

Additionally, the thrust rail 16 has a forth portion substantially in a form of a square bracket, which has an oblique line inclined backward extending from the connecting point with the guide rail 11 to an upper edge of the side wall 4, and a short straight line along the upper edge thereof. Thus, the thrust rail 16 has an inflexion point as a tilt position TC of the outboard motor 6. Referring to FIG. 9, when the thrust roller 20 is in engagement at the tilt position TC, upward motion thereof is restricted, thus holding the outboard motor 6 in a constant tilt state.

Referring again to FIG. 2, the reverse rail 17 is formed in an arc extending backward and upward from the anchorage set position TL on the thrust rail 16. Specifically, in a state where the thrust roller 20 is in engagement at the hump position TP, for example, the reverse rail 17 is so formed as to cross a rotation locus R—R of the lower portion of the thrust roller 20 when rotating on the guide roller 12. The reverse rail 17 has a lower end portion located lower than the rotation locus R—R, which serves as a reverse lock area RA in which the thrust roller 20 is surely in engagement without upward motion by backward thrust upon sternway. The reverse rail 17 has an arc-shaped portion located upper than the rotation locus R—R, which has a sudden rising line as a movement locus of the thrust roller 20 when the guide roller 12 is urged to move upward along the guide rails 11. Additionally, an upper end of the reverse rail 17 is located below same of the thrust rail 16 at a distance. This space as defined by the two upper ends of the rails 16 and 17 contributes to easy attachment-/detachment of the outboard motor bracket 8 to/from the stern bracket 3. It is to be noted that a reference numeral W designates a position of the center of gravity for a total weight of the outboard motor 6 and the outboard motor bracket 8.

Next, the operation of the first preferred embodiment will be described.

Figure 5:
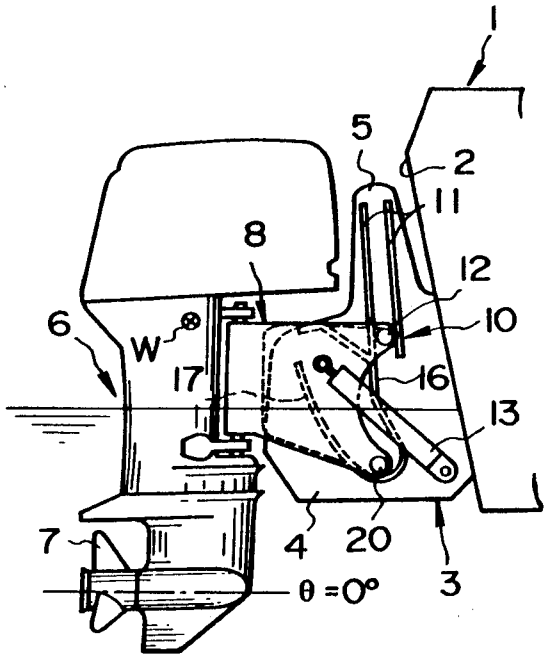
FIG. 5 is a view similar to FIG. 4, illustrating the outboard motor in an anchorage state.

Referring to FIG. 5, there is shown the outboard motor 6 in an anchorage state. In that event, due to a weight of the outboard motor 6, the thrust roller 20 is in engagement at the anchorage set position TL which is located at a connecting point of the thrust rail 16 with the reverse rail 17, assuming the trim angle $\theta$ (theta) of the outboard motor 6: $\theta=0°$.

Referring to FIG. 6, there is shown the outboard motor 6 in a hump state which occurs in the initial stage of forward navigation. Since the lift cylinder 13 is out of operation in that stage, the outboard motor 6 is inclined to rotate toward the hull 1 by forward thrust. This rotation is restrained when the thrust roller 20 is in engagement at the hump position TP on the thrust rail 16, assuming the trim angle $\theta$ (theta) of the outboard motor 6: $\theta \approx -4°$.

Referring to FIG. 7, there is shown the outboard motor 6 in a state of high-speed forward navigation. In that event, the outboard motor bracket 8 is lifted at the high set position TH on the thrust rail 16 by the lift cylinder 13, assuming the trim angle $\theta$ (theta) of the outboard motor 6: $\theta \approx +5°$. Thus, the propeller 7 has an upper portion which appears above the surface of planing, decreasing a fluid resistance of a lower housing 6*a* of the outboard motor 6, resulting in the improvement in high-speed performance thereof.

Referring to FIG. 8, there is shown the outboard motor 6 in a state of shallow-sea navigation. In that event, since the bilge is in possibility of coming in contact with the bottom of the sea, the hull 1 should be sailed at low speed. In this embodiment, during shallow-sea navigation, the outboard motor bracket 8 is lifted at the shallow-sea navigation position TS on the thrust rail 16 by the lift cylinder 13, assuming the trim angle $\theta$ (theta) of the outboard motor 6: $\theta = +4°$. In that event, since the surface of planing is substantially horizontal due to low-speed navigation, the propeller 7 completely submerges below the water, sufficiently preserving the thrust efficiency of the propeller 7. In the state of shallow-sea navigation, the trim angle $\theta$ (theta) of the outboard motor 6 may be established in accordance with the shape of the thrust rail 16 selected, and preferably equal to 0°.

Referring to FIG. 9, there is shown the outboard motor 6 in a tilt state. When the lift cylinder 13 is operated in a direction of maximal extension, the thrust roller 20 passes the hump position TP, the high set position TH, and the shallow-sea navigation position TS on the thrust rail 16. Then, it passes the connecting point of the thrust rail 16 with the guide rail 11, and arrives at the tilt position TC where the thrust roller 20 is engaged with the thrust rail 16, restraining upward motion of the thrust roller 20, thus tilting up, at a predetermined angle, the outboard motor 6 with the propeller 7 completely appearing above the water. In that event, since the guide roller 12 is guided upward along the guide rails 11, tilt-up of the outboard motor 6 is possible with a relatively small tilt angle, minimizing an amount of overhange l from the rear face of the transom 2 to the rear end of the propeller 7, contributing to easy tilt-up of the outboard motor 6 in a small harbor.

Figure 10:
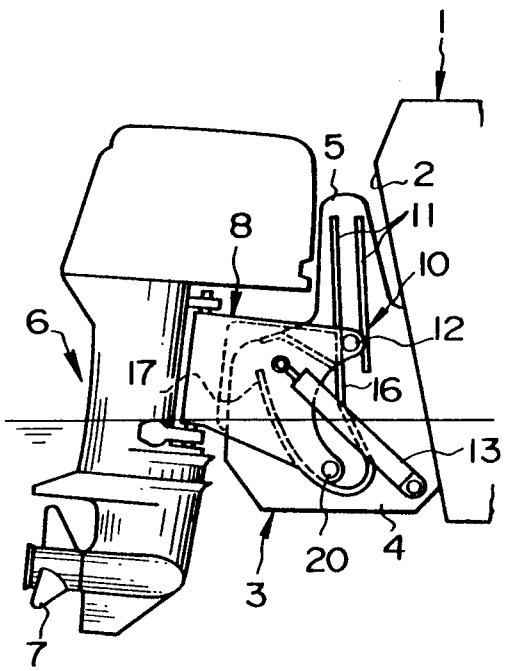
FIG. 10 is a view similar to FIG. 9, illustrating the outboard motor in a sternway state.

Referring to FIG. 10, there is shown the outboard motor 6 in a sternway state. Upon sternway, when driven to back astern in the anchorage state where the lift cylinder 13 is out of operation as shown in FIG. 5, the outboard motor 6 is inclined to rotate backward by backward thrust. The thrust roller 20 is then urged to move from the anchorage set position TL to the reverse lock area RA located at the lower portion of the reverse rail 17 so as to be engaged therewith, ensuring reverse lock of the outboard motor 6 to restrain backward rotation thereof. Specifically, since the reverse rail 17 has the upper portion assuming a sudden up-grade out of the reverse lock area RA, and the weight of the outboard motor 6 is greater than backward thrust, the thrust roller 20 fails to urge to move backward over the reverse lock area RA, ensuring reliable reverse lock of the outboard motor 6.

Figure 12:
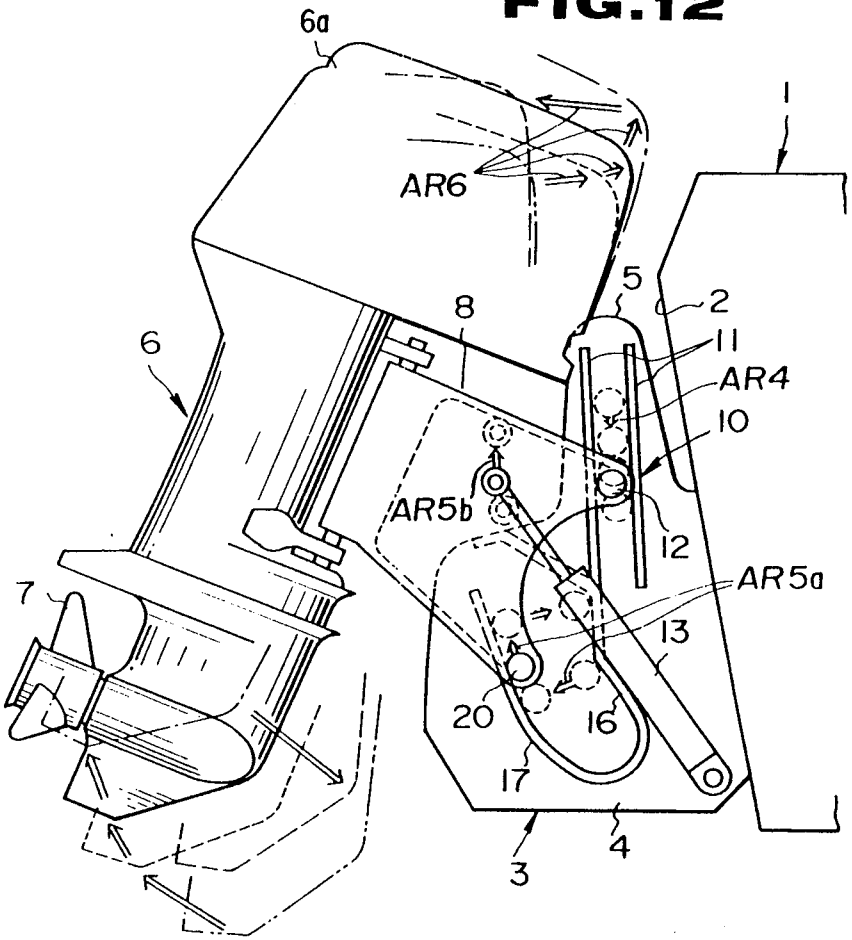
FIG. 12 is a view similar to FIG. 11, illustrating the outboard motor which is kicked up when assuming the high set state.
Figure 11:
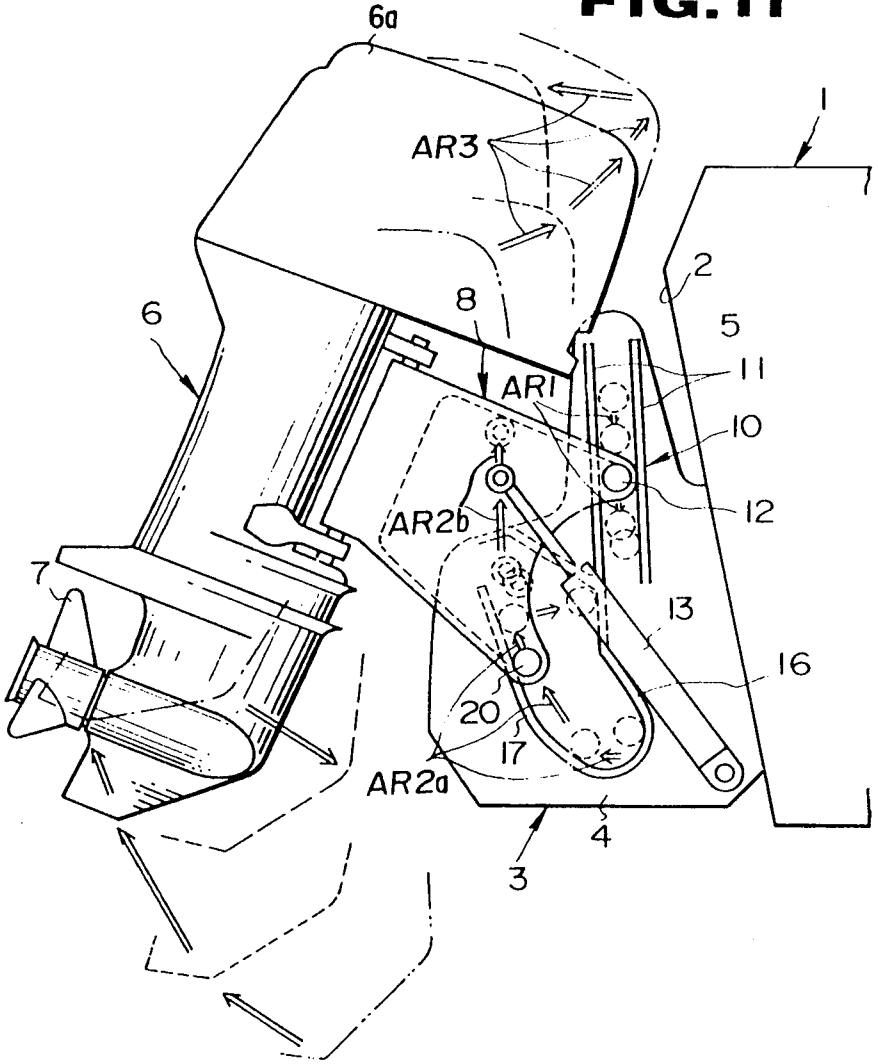
FIG. 11 is a view similar to FIG. 10, illustrating the outboard motor which is kicked up when assuming the hump state.

Referring to FIGS. 11 and 12, there are shown the outboard motor 6 in a kick-up state. When the outboard motor 6 has, during forward navigation, a collision with an obstacle such as a driftwood at the lower portion thereof, it should be kicked up backward to decrease a collision shock, and to pass the obstacle backward. In that event, a power head 6*a* of the outboard motor 6 as arranged at the upper side portion thereof should be prevented from interfering with the upper portion of the transom 2.

Referring to FIG. 11, there is shown the outboard motor 6 which is kicked up when assuming the hump state as shown in FIG. 6. Due to external force operating on the lower end of the outboard motor 6 in a backward direction, the thrust roller 20 is urged to move from the hump position TP on the thrust rail 16 so as to locate in the reverse lock area RA. The guide roller 12, and the thrust roller 20 are urged to move along the guide rails 11, and the reverse rail 17 respectively, as indicated by arrows AR1 and AR2*a*, AR2*b* in FIG. 11, thereby to kick the outboard motor 6 up as indicated by arrows AR3 in FIG. 11. After passage of the obstacle such as a drift wood, the outboard motor 6 immediately rotates forward on the guide roller 12 due to its own weight, and the thrust roller 20 is urged to move from the upper portion of the reverse rail 17 so as to locate in the thrust rail 16, thus assuming a previous position.

Referring to FIG. 12, there is shown the outboard motor 6 which is kicked up when assuming the high set state as shown in FIG. 7. In that event, also, due to external force operating on the lower end of the outboard motor 6 in a backward direction, the thrust roller 20 is urged to move from the high set position TH on the thrust rail 16 so as to locate in the upper portion of the reverse rail 17. The guide roller 12, and the thrust roller 20 are urged to move along the guide rails 11, and the reverse rail 17, respectively, as indicated by arrows AR4 and AR5*a*, AR5*b* in FIG. 12, thereby to kick the outboard motor 6 up as indicated by arrows AR6 in FIG. 12. After passage of the obstacle such as a drift wood, the thrust roller 20 is urged to move from the reverse rail 17 in accordance with forward rotation of the outboard motor 6 so as to locate in the thrust rail 16, thus assuming a previous position.

In all of the cases as described above, since the guide roller 12 is urged to move along the straight lines of the guide rails 11, and the thrust roller 20 is urged to move along the arc-shaped line of the reverse rail 17 so as to obtain kick-up operation of the outboard motor 6, the outboard motor 6 has a reduced backward rotation angle, preventing interference of the power head 6*a* with the upper portion of the transom 2.

Figure 13:
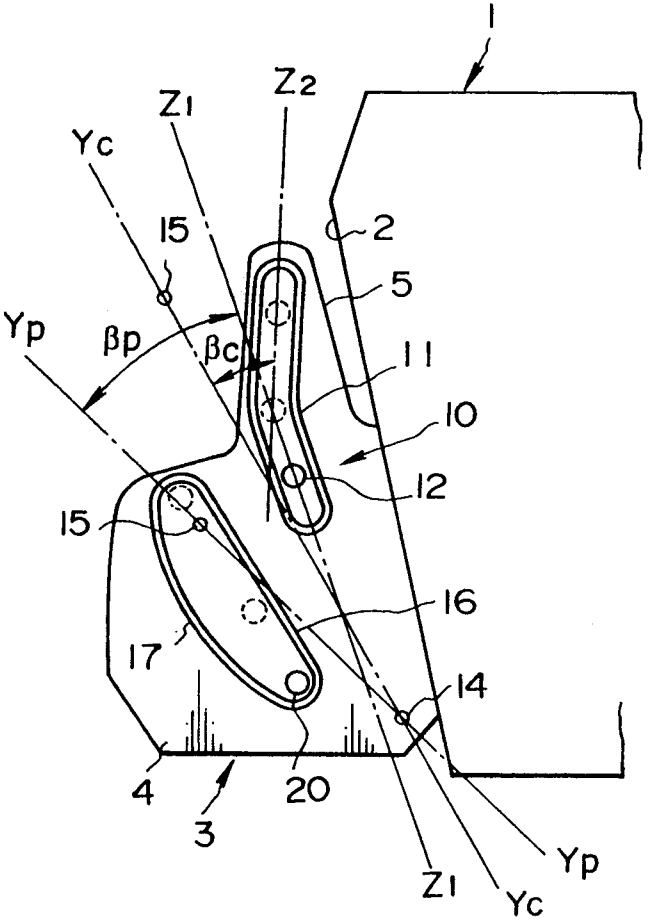
FIG. 13 is a view similar to FIG. 2, illustrating a second preferred embodiment of a supporting device for an outboard motor according to the present invention.

Referring to FIG. 13, in a second preferred embodiment, the thrust rail 16 is arranged straightly in a backward inclined manner, and connected to the reverse rail 17 at the upper and lower ends thereof. Similarly, the guide rails 11 are connected each other at the upper and lower ends thereof to obtain increased rail strength. Particularly, in the second preferred embodiment, the thrust rail 16 is arranged straightly in a backward inclined manner, and the guide rails 11 have a lower half portion as inclined backward, and an upper half portion as arranged straightly, thus obtaining predetermined values of trim angle when the outboard motor 6 is in the hump state, and the high set state by cooperation of guide function of the thrust rail 16 and the thrust roller 20, and same of the guide rails 11 and the guide roller 12. Additionally, the guide rails 11 have upper and lower stop ends which are distantly arranged to prevent the guide roller 12 from coming in contact therewith when stroking, and the thrust roller 20 is surely in engagement at upper and lower connecting points on the reverse rail 17 to ensure the stop function.

Due to the lower half portion of the guide rails 11 as inclined backward, it is possible to decrease an angle $\beta_P$ (beta p) formed by a center line $Z_1$—$Z_1$ of the lower half portion of the guide rails 11, and an axis $Y_P$—$Y_P$ of the lift cylinder 13. It is to be noted that, when the guide roller 12 is positioned in the lower half portion of the guide rails 11, the outboard motor 6 undergoes relatively great forward thrust. In that state, if the angle $\beta_P$ (beta p) is small as described above, the outboard motor 6 is easy to operate by the lift cylinder 13 without great slide resistance between each roller and rail. On the other hand, due to the upper half portion of the guide rollers 11 as arranged straightly, an angle $\beta_C$ (beta c) as formed by a center line $Z_2$—$Z_2$ of the upper half portion of the guide rails 11, and the axis $Y_C$—$Y_C$ of the lift cylinder 13 when the guide roller 12 is urged to move in the upper half portion of the guide rollers 11 is slightly increased. It is to be noted that, when the guide roller 12 is positioned in the upper half portion of the guide rails 11, the outboard motor 6 undergoes relatively small forward thrust, e.g. upon shallow-sea navigation, or null forward thrust, e.g. upon tilt-up. Thus, upon lift operation, smoothly developed motion of the rollers 12 and 20 can be obtained without any particular problem.

Figure 14:
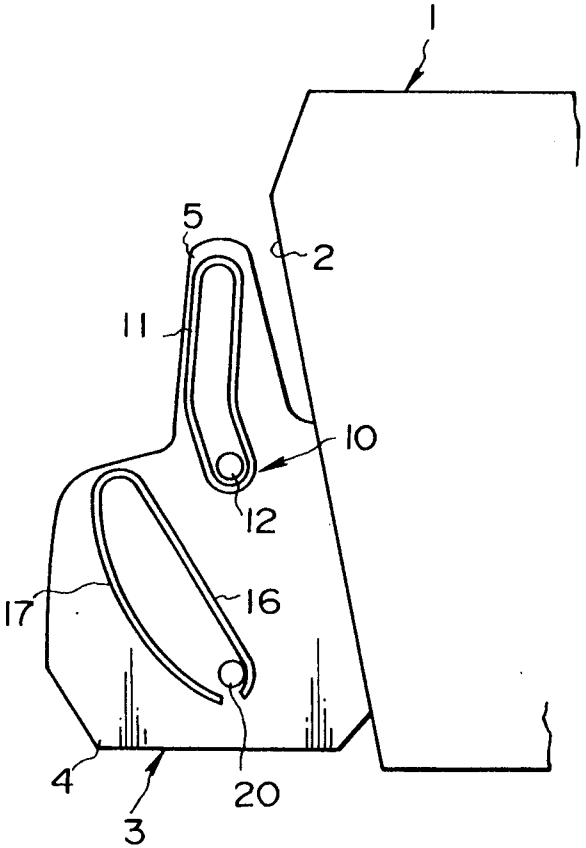
FIG. 14 is a view similar to FIG. 13, illustrating a third preferred embodiment of a supporting device for an outboard motor according to the present invention.

Referring to FIG. 14, in a third preferred embodiment which is a variation form of the second preferred embodiment as shown in FIG. 13, the thrust rail 16 is not connected to the reverse rail 17 at the lower end thereof so as to have an opening through which a foreign body as introduced inside the reverse rail 17 is thrown away in the sea. On the other hand, the lower stop end of the guide rails 11 is positioned up so as to support the weight of the outboard motor 6 by engagement of the lower stop end of the guide rails 11 with the guide roller 12.

What is claimed is:

1. A supporting device for an outboard motor, wherein the outboard motor is mounted to a transom of a hull, comprising;

a first bracket mounted to the transom;

a thrust rail mounted to said first bracket;

a reverse rail mounted to said first bracket, said reverse rail being arranged opposite said thrust rail;

a second bracket having one end supporting the outboard motor, and the other end including one portion;

a thrust roller rotatably mounted to said one portion of said second bracket and being engagable with said thrust rail and said reverse rail;

means for allowing said second bracket to slidably and rotatable move relative to said first bracket, said allowing means being formed on said first bracket and including a pair of guide rails and a guide roller, said pair of guide rails being arranged in parallel; and means for driving said second bracket, said driving means having one end connected to the hull and the other end connected to said second bracket.

2. A supporting device as claimed in claim 1, wherein said pair of guide rails have both ends connected, and have one half portion as inclined toward the outboard motor.

3. A supporting device as claimed in claim 1, wherein said thrust rail has both ends connected to said reverse rail.

4. A supporting device as claimed in claim 1, wherein said thrust rail has one end connected to said reverse rail, and the other end opened.

5. A supporting device as claimed in claim 1, wherein said driving means include a lift cylinder.

6. A supporting device as claimed in claim 1, wherein one of said pair of guide rails has one end connected to said thrust rail.

* * * * *